US010312037B1

(12) United States Patent
Clark et al.

(10) Patent No.: US 10,312,037 B1
(45) **Date of Patent: *Jun. 4, 2019**

(54) ROTARY MOTION SWITCHING APPARATUS USABLE WITH CIRCUIT INTERRUPTER

(71) Applicant: EATON CORPORATION, Cleveland, OH (US)

(72) Inventors: John Thomas Clark, Beaver, PA (US); Ramesh Shivaji Powar, Kolhapur (IN); Sujit Subhash Patwardhan, Pune (IN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

This patent is subject to a terminal disclaimer.

(21) Appl. No.: 15/875,177

(22) Filed: Jan. 19, 2018

(51) Int. Cl.
*H01H 19/04* (2006.01)
*H01H 19/14* (2006.01)
*H01H 19/08* (2006.01)

(52) U.S. Cl.
CPC ..... *H01H 19/04* (2013.01); *H01H 19/08* (2013.01); *H01H 19/14* (2013.01)

(58) Field of Classification Search
CPC ..... H01H 19/04; H01H 19/08; H01H 19/14; H01H 3/08; H01H 71/56; H01H 71/46; H01H 2071/565
USPC ..... 200/293, 329–331, 336
See application file for complete search history.

(56) References Cited

U.S. PATENT DOCUMENTS

| | | | | |
|---|---|---|---|---|
| 3,260,808 | A | 7/1966 | Dimond et al. | |
| 3,324,259 | A | 6/1967 | Chamberlin, Jr. et al. | |
| 5,288,958 | A * | 2/1994 | Grunert | H01H 9/22 200/329 |
| 5,493,084 | A * | 2/1996 | Whitaker | H01H 3/10 200/330 |
| 6,423,912 | B1 * | 7/2002 | Arenz | H01H 9/282 200/336 |
| 6,518,526 | B2 | 2/2003 | Hamada et al. | |
| 6,566,618 | B2 * | 5/2003 | Hamada | H01H 71/56 200/308 |
| 6,969,813 | B1 | 11/2005 | Winslett et al. | |
| 7,002,088 | B2 * | 2/2006 | Shin | H01H 71/56 200/330 |
| 7,399,934 | B2 * | 7/2008 | Emura | H01H 9/22 200/43.11 |

* cited by examiner

*Primary Examiner* — Edwin A. Leon
(74) *Attorney, Agent, or Firm* — Eckert Seamans

(57) ABSTRACT

A rotary motion switching apparatus is usable with a circuit interrupter and employs an attachment system having a pair of connectors that are received in a pair of openings formed in a housing of a circuit interrupter and that are affixed to the housing within the openings in order to resist removal of the rotary motion switching apparatus from the circuit interrupter. The openings are pre-existing in the housing of the circuit interrupter and are provided to enable access by tools with terminals of the circuit interrupter to which load wires and the like are connectable. The connectors thus secure the rotary motion switching apparatus to the circuit interrupter by using openings that are already formed in the circuit interrupter and thus the rotary motion switching apparatus is usable without requiring a modification to the housing or to the molds that are employed to form the housing.

13 Claims, 5 Drawing Sheets

ROTARY MOTION SWITCHING APPARATUS USABLE WITH CIRCUIT INTERRUPTER

BACKGROUND

Field

The disclosed and claimed concept relates generally to electrical switching equipment and, more particularly, to a rotary motion switching apparatus that is usable with a circuit interrupter.

Related Art

Numerous types of switching equipment is known in the relevant art. Among such switching equipment are any of a wide variety of circuit interrupters that are known to interrupt electrical power to a protected portion of a circuit in certain overcurrent and under-voltage conditions, as well as in numerous other predefined conditions. While such circuit interruption devices have been generally effective for their intended purposes, they have not been without limitation.

In certain applications, it is necessary for a circuit interrupter to be situated within an interior region of a National Electrical Manufacturers Association (NEMA) box for any of a wide variety of reasons. As is known in the relevant art, circuit interrupters typically have a handle that is movable among ON, OFF, and TRIPPED positions, and it is thus also known that the switching of the circuit interrupter between those positions can be made more difficult if the circuit interrupter is situated within the interior of a NEMA box. While some solutions have been known to exist in which a control mechanism extends between a circuit interrupter situated within the interior of a NEMA box and a handle or other implement situated at the exterior of the NEMA box, such solutions have typically involved a number of modifications to the to the housing of the circuit interrupter or to the molding that is used to mold the housing of the circuit interrupters, thus resulting in undesirable expense. As employed herein, the expression "a number of" and variations thereof shall refer broadly to any non-zero quantity, including a quantity of one. Improvements thus would be desirable.

SUMMARY

An improved rotary motion switching apparatus is usable with a circuit interrupter and employs an attachment system having a pair of connectors that are received in a pair of openings that are already formed in a housing of a circuit interrupter and that are affixed to the housing within the openings in order to resist removal of the rotary motion switching apparatus from the circuit interrupter. The openings are pre-existing in the housing of the circuit interrupter and are provided to enable access by tools such as screwdrivers and the like with terminals of the circuit interrupter to which load wires and the like are connectable. The connectors thus secure the rotary motion switching apparatus to the circuit interrupter by using openings that are already formed in the circuit interrupter and thus the rotary motion switching apparatus is usable without requiring a modification to the housing or to the molds that are employed to form the housing.

Accordingly, an aspect of the disclosed and claimed concept is to provide an improved rotary motion switching apparatus that is usable in conjunction with a circuit interrupter and a NEMA box but that does not require modification of the housing of the circuit interrupter and that likewise does not require any modification of the mold that is employed to form the housing.

Accordingly, an aspect of the disclosed and claimed concept is to provide an improved rotary motion switching apparatus that is usable with a circuit interrupter, the circuit interrupter having a housing, a switch situated on the housing, and at least a first opening formed in the housing. The rotary motion switching apparatus can be generally stated as including a base, an attachment system situated on the base, the attachment system can be generally stated as including at least a first connector that is elongated, the at least first connector being structured to be at least partially received in the at least a first opening and being further structured to engage the housing within the at least first opening to resist removal of the at least first connector from the at least first opening and to affix the base to the housing, a crank apparatus situated on the base, the crank apparatus can be generally stated as including a first portion and a second portion, the first portion being pivotable about an axis of rotation between a first orientation and a second orientation, the first portion and the second portion being engaged with one another at a location spaced from the axis of rotation, at least a part of the second portion being translatable along a movement axis between a first position and a second position, the first portion being in the first orientation when the at least part of the second portion is in the first position, the first portion being in the second orientation when the at least part of the second portion is in the second position, and the second portion having a number of lugs that are structured to engage the switch and to move the switch between a first state and a second state, the at least part of the second portion being structured to be in the first position when the switch is in the first state, the at least part of the second portion being structured to be in the second position when the switch is in the second state.

BRIEF DESCRIPTION OF THE DRAWINGS

A further understanding of the disclosed and claimed concept can be gained from the following Description when read in conjunction with the accompanying drawings in which:

Similar numerals refer to similar parts throughout the specification.

DESCRIPTION

Figure 1:
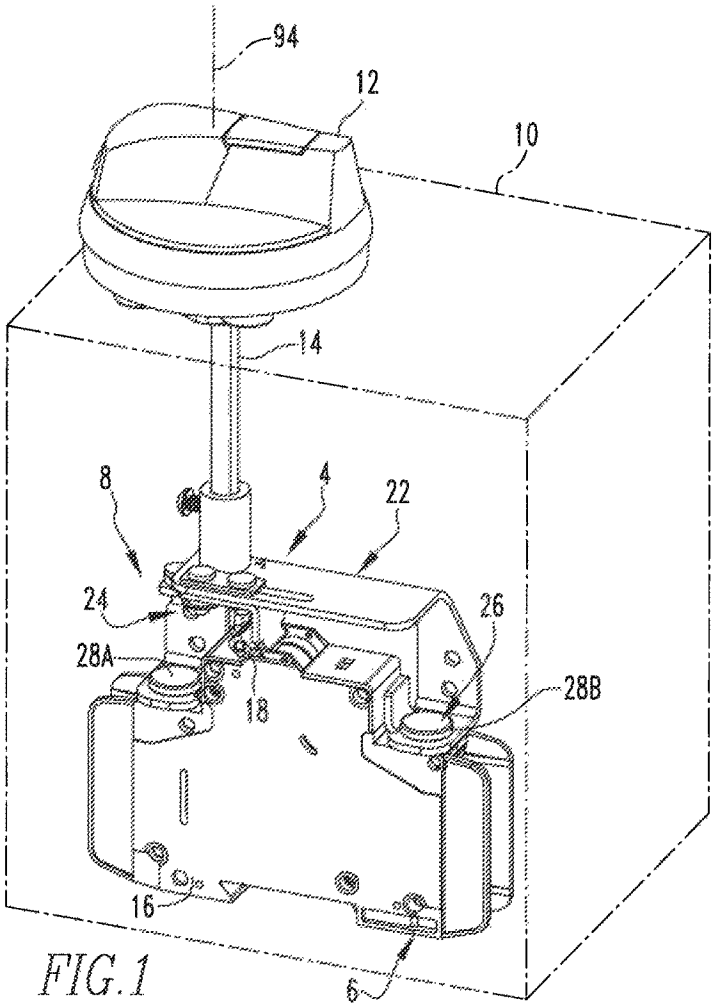
FIG. 1 is a perspective view of an improved rotary motion switching apparatus situated on a circuit interrupter and being disposed inside a NEMA box that is depicted in phantom lines, with the rotary motion switching apparatus being in a first position and with the circuit interrupter being in a first state.
Figure 2:
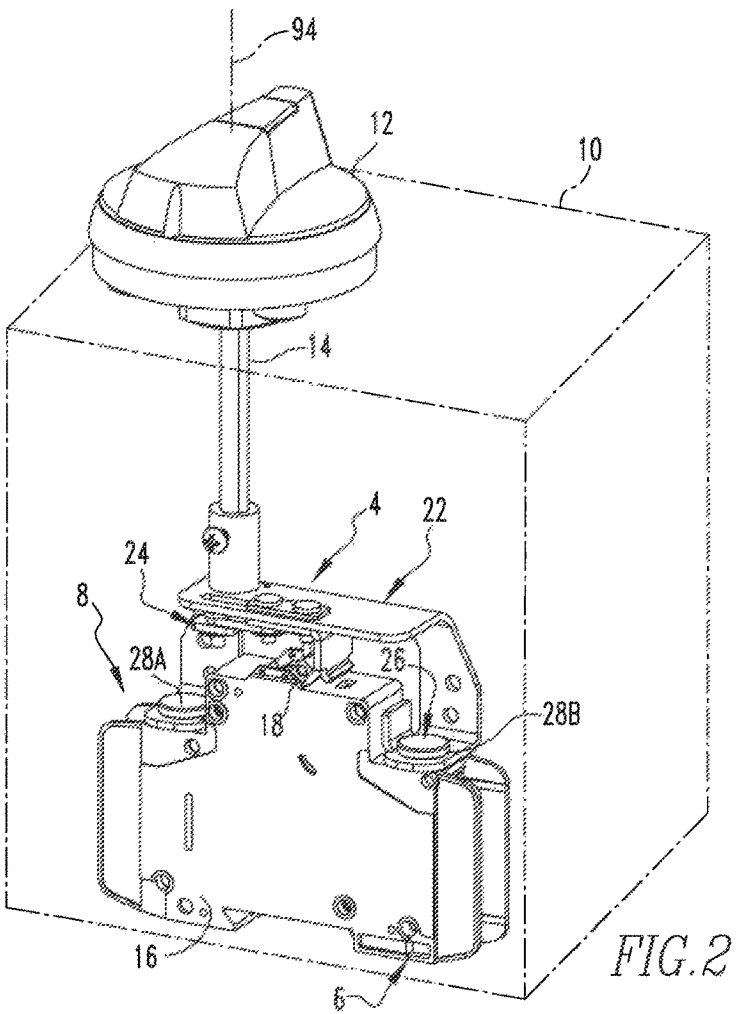
FIG. 2 is a view similar to FIG. 1, except depicting the rotary motion switching apparatus in a second position and depicting the circuit interrupter in a second state.
Figure 3:
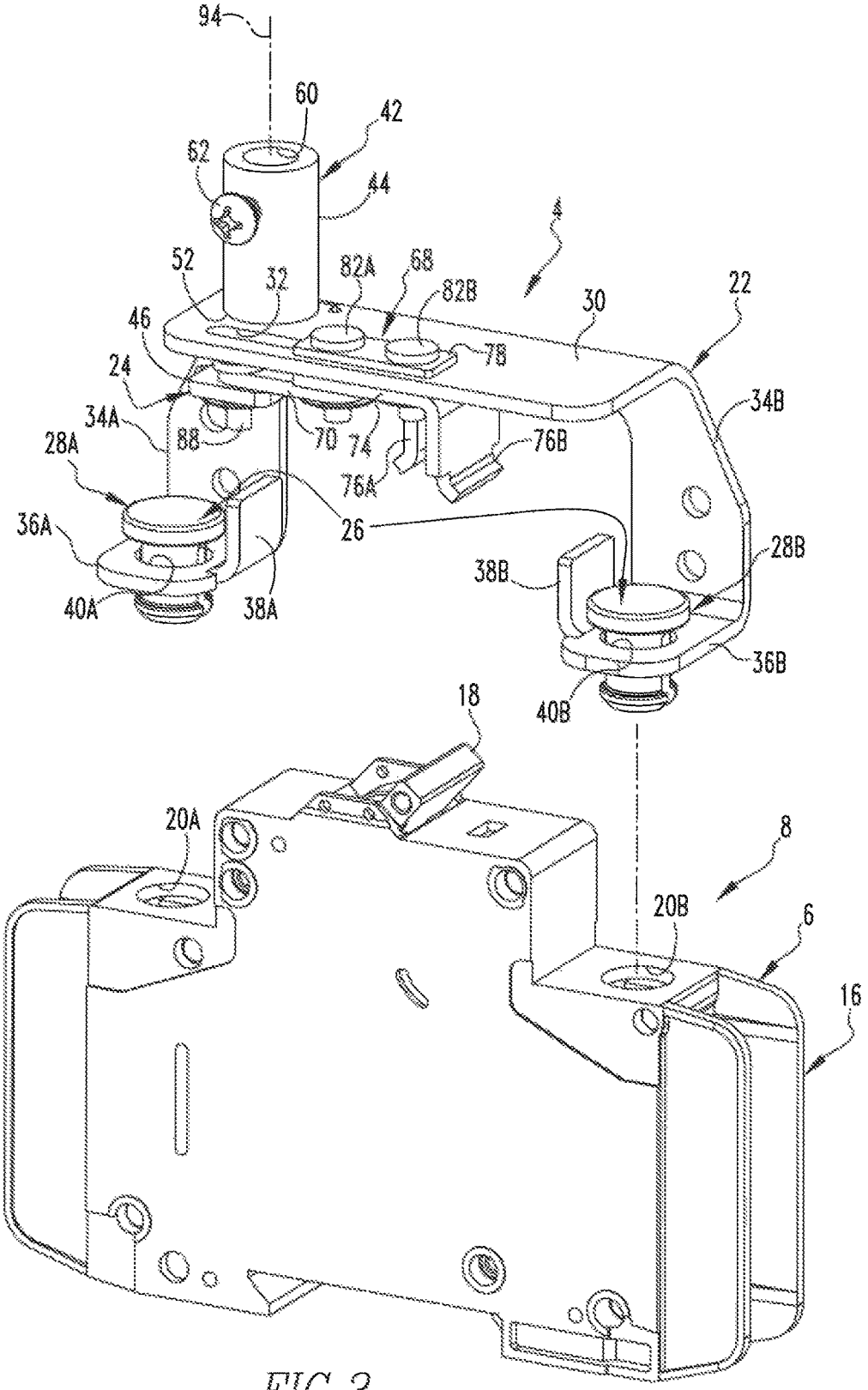
FIG. 3 is a view showing an improved assembly in accordance with the disclosed and claimed concept in which the rotary motion switching apparatus of FIG. 2 is exploded away from the circuit interrupter of FIG. 2.
Figure 4:
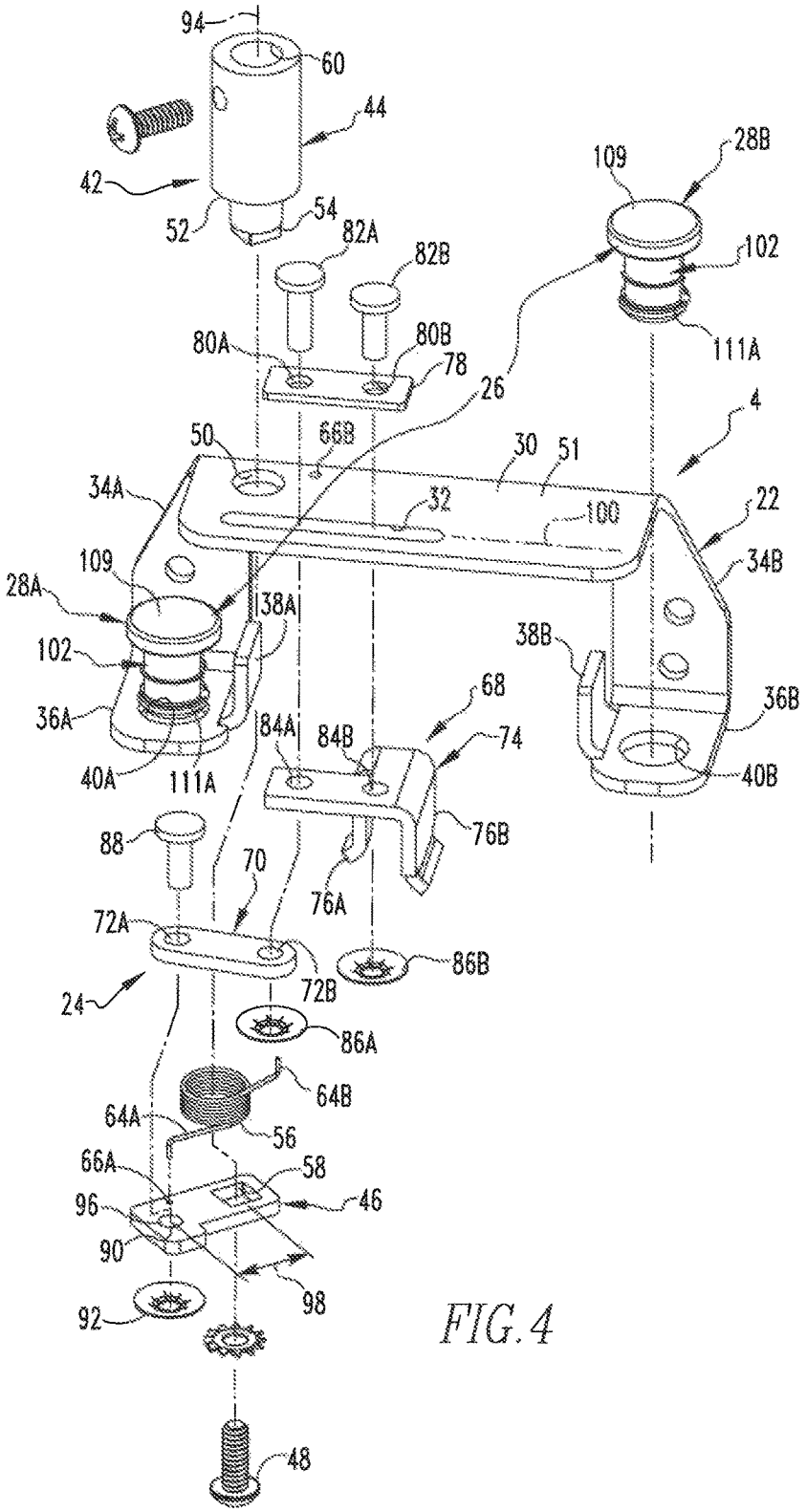
FIG. 4 is an exploded view of the rotary motion switching apparatus of FIG. 3.

An improved rotary motion switching apparatus 4, which may be alternatively referred to herein as the apparatus 4, is depicted in FIGS. 1-7 and is depicted in an exploded fashion in FIG. 4. The apparatus 4 is usable in conjunction with a circuit interrupter 6 such as is depicted in FIGS. 1-3 to form an assembly 8 that is likewise in accordance with the disclosed and claimed concept. Furthermore, the apparatus 4 is usable with a plurality of ganged circuit interrupters, such as are indicated at the numeral 106 in FIG. 7.

Figure 7:
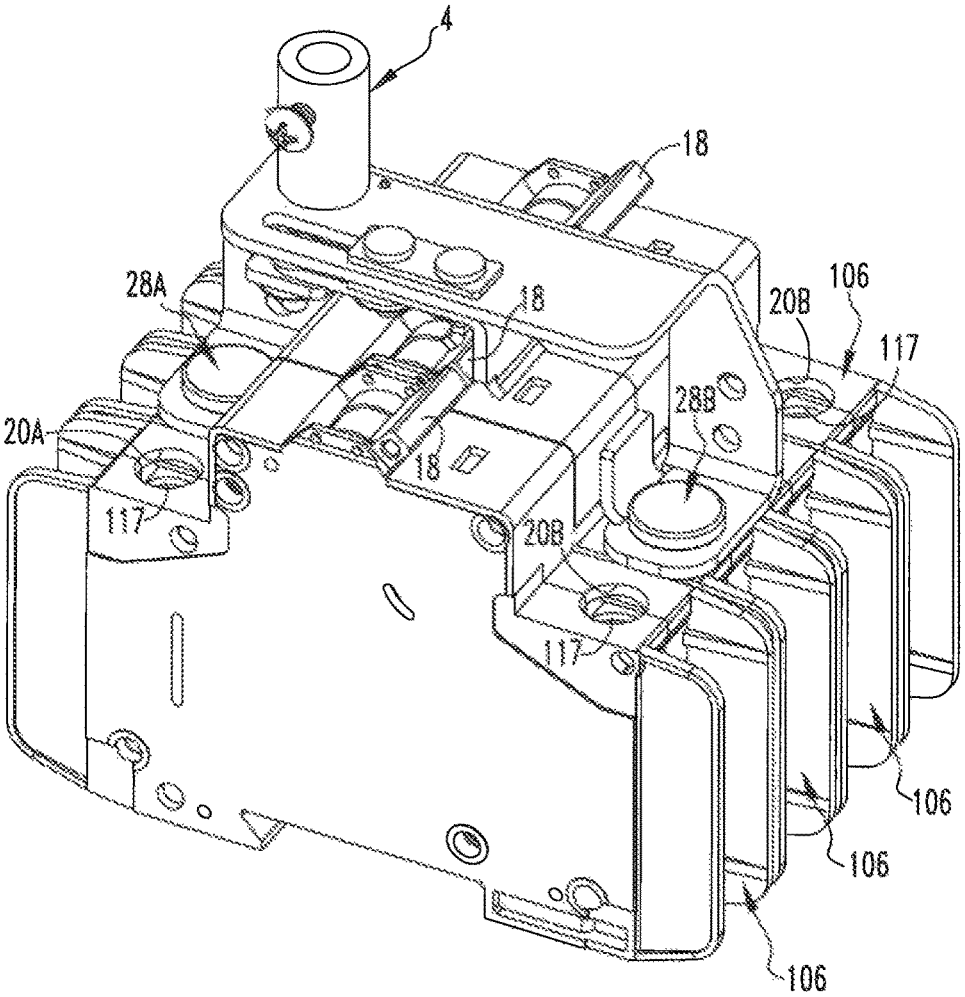
FIG. 7 is a view of the rotary motion switching apparatus being mounted to a circuit interrupter from among a plurality of circuit interrupters that are ganged together.

As can be understood from FIGS. 1 and 2, the apparatus 4 is usable in conjunction with the circuit interrupter 6 (or with multiple instances of circuit interrupters 106, such as are indicated in FIG. 7) to form the assembly 8 when the assembly 8 is used inside a NEMA box 10 that is indicated in FIGS. 1 and 2 in phantom lines. More specifically, the NEMA box 10 includes a handle 12 that is situated at an exterior of an enclosure of the NEMA box 10 and further includes a shaft 14 that is elongated, with one end of the shaft 14 being connected with the handle 12, and with an opposite end of the shaft 14 being connected with the apparatus 4. Depending upon the dimensions of the NEMA box 10, the shaft 14 can be cut to an appropriate length such that its opposite ends extend between the handle 12 and the apparatus 4.

As can be understood from FIGS. 1-3, the circuit interrupter 6 includes a housing 16 that is molded from an appropriate resin material or other material and a switch 18 that is movably situated on the housing 16. The switch 18 in the depicted exemplary embodiment is movable between an ON position and an OFF/TRIPPED position to switch the circuit interrupter 6 among a plurality of states in a well understood fashion. The housing 16 further includes a pair of openings formed therein that are indicated at the numerals 20A and 20B, and which may be collectively or individually referred to herein with the numeral 20. The openings 20 are provided in the housing 16 in order enable tools such as screwdrivers and the like to be receivable therein and to be cooperable with terminals of the circuit interrupter 6 that enable electrical connection between the circuit interrupter 6 and load conductor wires and other wires, by way of example.

As can be understood from FIG. 3, the apparatus 4 is provided separately from the circuit interrupter 6 and is mountable to the housing 16 of the circuit interrupter 6 by having portions thereof received in the openings 20. Since the openings 20 are pre-existing in the housing 16 for the reception of tools therein in order to connect wires with terminals of the circuit interrupter 6, the apparatus 4 advantageously is usable with the circuit interrupter 6 without requiring any modification of the housing 16 or of the mold that is used to form the housing 16, which is highly advantageous from a cost standpoint.

As can be understood from FIGS. 1-6, the apparatus 4 can be said to include a base 22, a crank apparatus 24 that is situated on the base 22, and an attachment system 26 that is mounted on the base 22 and which secures the apparatus 4 to the housing 16. In the depicted exemplary embodiment, the attachment system 26 includes a pair of connectors that are indicated at the numerals 28A and 28B, and which may be collectively or individually referred to herein with the numeral 28. When the connectors 28 are fully received in the openings 20, such as is indicated in FIGS. 1 and 2, the apparatus 4 is mounted to and affixed to the circuit interrupter 6.

As is best shown in FIG. 4, the base 22 can be said to include a main plate 30 in which an elongated slot 32 is formed. The base 22 further includes a pair of connection plates 34A and 34B, which may be collectively or individually referred to herein with the numeral 34, and that are connected with the main plate 30. The base 22 further includes a pair of base plates 36A and 36B, which may be collectively or individually referred to herein with the numeral 36, and which are connected with the connection plates 34A and 34B, respectively. The base 22 further includes a pair of tabs 38A and 38B, which may be collectively or individually to herein with the numeral 38, which are situated on the base plates 36A and 36B, respectively. The tabs 38 are in a confronting relationship with one another. The base plates 36A and 36B have formed therein a pair of holes 40A and 40B, respectively, and which may be collectively or individually referred to herein with the numeral 40. As can be understood from FIG. 4, the base plates 36 are oriented substantially parallel with the main plate 30, and the connection plates 34 are oriented substantially perpendicular to the main plate 30 and the base plates 36. When the apparatus 4 is mounted to the circuit interrupter 6 with the connectors 28 being fully received in the openings 20, the tabs 38 confrontingly engage therebetween a portion of the housing 16 such that the portion of the housing 16 is interposed between the tabs 38 to advantageously resist movement of the base 22 with respect to the housing 16 along a direction parallel with the longitudinal extent of the slot 32. As can be further understood from FIG. 4, the connectors 28A and 28B are receivable in the holes 40A and 40B, respectively.

As can further be understood from FIG. 4, the crank apparatus 24 includes a crank 42 which can be said to include a boss 44, a crank plate 46, and a screw 48. The screw 48 engages an underside of the crank plate 46 and fastens the crank plate 46 to the boss 44. The crank 42 can be said to constitute a first portion 42 of the crank apparatus 24.

The main plate 30 has an aperture 50 formed therein within which the boss 44 is receivable. When the crank 42 is installed on the base 22, a shoulder 52 of the boss 44 is receivable against an upper surface 51 of the main plate 30. The boss 44 can be said to include a tip 54 that is of a rectangular shape and which is receivable through a spring 56 and is receivable in a rectangular hole 58 that is formed in the crank plate 46. With the tip 54 received in such fashion in the rectangular hole 58, the screw 48 can be received in a threaded hole formed in the tip 54 in order to connect together the boss 44 and the crank plate 46 in a condition installed on the base 22.

As can further be understood from FIG. 4, the boss 44 can be said to have a receptacle 60 formed therein at an end thereof opposite the tip 54 and which is configured to receive therein the corresponding end of the shaft 14. The boss 44 further includes a set screw 62 that is receivable in a hole in the side of the boss 44 and which is configured to be tightened in the hole and to compressively engage a flat surface of the shaft 14 in order to affix the shaft 14 and the crank 42 together.

It can be seen that the spring 56 includes a pair of legs that are indicated at the numerals 64A and 64B, which may be collectively or individually referred to herein with the numeral 64. The legs 64A and 64B are received in a pair of openings 66A and 66B, respectively, and which may be collectively or individually referred to herein with the numeral 66. When the legs 64 are received in the openings 66, the openings 66 serve as seats for the legs 64 and which enable the spring 56 to rotationally bias the crank 42 in a desirable fashion that is tailored to the needs of the particular application. For instance, the spring 56 may rotationally bias the crank apparatus 24 toward an OFF or TRIPPED state of the circuit interrupter 6, by way of example and without limitation.

As can further be understood from FIG. 4, the crank apparatus 24 further includes a slider 68 and a link 70 which together can be said to form a second portion of the crank apparatus 24 that is cooperable with the first portion of the crank apparatus 24, i.e., the crank 42. The link 70 is pivotably connected with both the slider 68 and the crank 42 via pinned connections therebetween, as will be set forth in greater detail below. More specifically, the link 70 has formed therein a pair of holes 72A and 72B, which may be collectively or individually referred to herein with the numeral 72, and which receive therein pins that enable the pivotable connections to exist between the link 70 and each of the crank 42 and the slider 68.

The slider 68 can be said to include a main portion 74 having formed therein a pair of holes 84A and 84B, which may be collectively or individually referred to herein with the numeral 84. The slider 68 further includes a pair of lugs 76A and 76B, which may be collectively or individually referred to herein with the numeral 76, that are connected with the main portion 74 and that are cooperable with the switch 18 to move it among its various positions. The lugs 76 are in a confronting relationship with one another. The slider 68 further includes a fastening plate 78 that has formed therein a pair of holes 80A and 80B, which may be collectively or individually referred to herein with the numeral 80. The slider 68 further includes a pair of pins 82A and 82B, that are receivable in the holes 80 of the fastening plate, through the slot 32, and are receivable in the holes 84 and which are cooperable with a pair of locking fasteners 86A and 86B. It is noted, however, that the pin 82A is additionally received through the hole 72B in the link 70 before being connected with the locking fastener 86A. The locking fastener 86A receives the pin 82A in a locking opening formed therein and is receivable against an underside of the link 70 adjacent the hole 72B. In a like fashion, the locking fastener 86B receives the pin 82B in a locking opening formed therein and is receivable against an underside of the main portion 74. In such a fashion, the slider 68 is mounted to the base 22 and is slidably translatable along the main plate 30 via sliding movement of the pins 82 within the slot 32. Furthermore, the link 70 is pivotably connected with the slider 68.

The crank apparatus 24 further includes a pin 88 that is receivable in the hole 72A in the link 70 and that is further received through a hole 90 that is formed in the crank plate 46. The pin 88 is further received in a locking opening of a locking fastener 92 that is receivable against an underside of the crank plate 46 to provide the pivotable connection between the link 70 and the crank 42.

As can be understood from the accompanying figures, the crank 42 is rotatable about an axis of rotation 94 between a first orientation such as is depicted generally in FIG. 1 and a second orientation such as is depicted generally in FIG. 2. The axis of rotation 94 extends through the rectangular hole 58 formed in the crank plate 46 and further extends through the aperture 50 formed in the main plate 30. The hole 90 in the crank plate 46 is situated at a location 96 that is spaced a distance 98 from the axis of rotation 94. Since the link 70 is pivotably connected between the crank 42 and the slider 68, it can be understood that rotational movement of the crank 42 about the axis of rotation 94 is converted via the link 70 being connected with the crank 42 at the location 96 spaced the distance 98 from the axis of rotation 94 into translational movement of the slider 68 within the slot 32 along a movement axis 100 that is parallel with the slot 32. More specifically, and as can be understood from FIGS. 1 and 2, when the crank 42 is in its first orientation, such as is depicted in FIG. 1, the slider 68 is in a first position. In a like fashion, when the crank 42 is in its second orientation, such as is depicted generally in FIG. 2, the slider 68 is in a second position. Since the crank apparatus 24 transforms rotational movement of the handle 12 and the shaft 14 applied to the crank 42 into translational movement of the slider 68 along the movement axis 100, it can be seen that such rotation of the handle 12 causes the lugs 76 to engage the switch 18 of the circuit interrupter 6 and to move the switch 18 among its various positions, which changes the circuit interrupter 6 among its various states.

Figure 5:
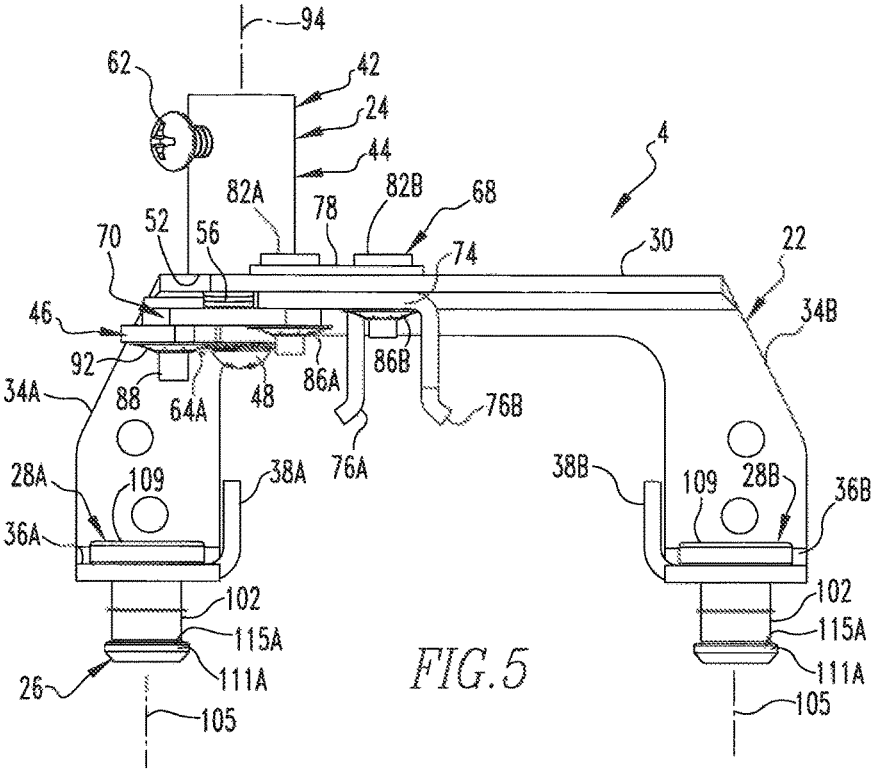
FIG. 5 is a front elevational view of the rotary motion switching apparatus.
Figure 6:
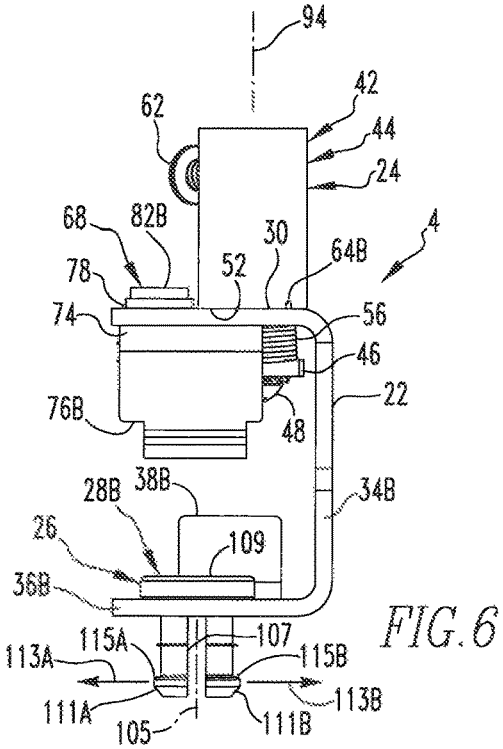
FIG. 6 is a side elevational view of the rotary motion switching apparatus.

As is best shown in FIGS. 4-6, the connectors 28 can be said to each include an elongated body 102 that is elongated along a direction of elongation 105 and which has formed therein an elongated notch 107 that is elongated along the direction of elongation 105. Each connector 28 further includes a head 107 at one end thereof and a pair of latches that are situated thereon opposite the head 109 and which are indicated at the numerals 111A and 111B, which may be collectively or individually referred to herein with the numeral 111. The latches 111A and 111B extend away from the notch 107 in a pair of directions that are indicated at the numerals 113A and 113B, respectively, and which may be collectively or individually referred to herein with the numeral 113. In the depicted exemplary embodiment, the directions 113 are each perpendicular to the direction of elongation 105 and are opposite one another.

The latches 111A and 111B each have an engagement surface 115A and 115B, respectively, which may be collectively or individually referred to herein with the numeral 115. In the depicted exemplary embodiment, the engagement surfaces 115 are of a generally planar configuration and are oriented perpendicular to the direction of elongation 105. When the connectors 28 are fully received in the openings 20, the engagement surfaces 115 engage a structure 117 of the housing that is best shown in FIG. 7. In the depicted exemplary embodiment, the structure 117 is an annular flange that is situated adjacent the opening 20 and that confrontingly engages the engagement surfaces 115 when the connectors 28 are received in the openings 20. Such engagement between the engagement surfaces 115 and a corresponding surface of the structure 117 advantageously resists removal of the connectors 28 from the openings 20 and thus likewise resists removal of the apparatus 4 from the circuit interrupter 6. In such a situation, the engagement surfaces 115 directly confront and engage a corresponding confronting surface of the structure 117 and thus enable the connectors 28 to remain affixed to the housing 16 within the openings 20.

It is noted that the direction of elongation 113 is substantially parallel with the axis of rotation 94 such that any reaction of the rotation of the handle 12 that is applied to the connectors 28 results in the bodies 102 compressively engaging the housing 16 within the openings 20 rather than applying forces between the engagement surfaces 115 and the structures 117. As such, any forces that may be applied to the connectors 28 as a result of application of a torque to the handle 12 at most further engage the bodies 102 with the housing 16 within the openings 20 without compromising the connection between the engagement surfaces 115 and the structures 117. Furthermore, it is noted that the engagement of the tabs 38 with the housing 16 resists the application of any meaningful torque to the connectors 28 due to rotation of the handle 12.

It thus can be seen that the apparatus 4 is affixable to the circuit interrupter 6 by receiving the connectors 28 in the openings 20, which enables the apparatus 4 to be affixed to the circuit interrupter 6 using the pre-existing openings 20 and without a need of modifying the housing 16 or the tooling that is used to form the housing 16. The apparatus 4 converts rotary motion of the handle 12 of the NEMA box 10 into translation of the slider 68 which is cooperable with the switch 18 to move the circuit interrupter 6 among its various states. This provides an advantageously workable solution at relatively low cost.

As noted above, and as can be seen in FIG. 7, the rotary switching apparatus 4 is connectable with a plurality of circuit interrupters 106 that are ganged together, with four of the circuit interrupters 106 being depicted in FIG. 7 as being ganged together. The apparatus 4 can be mounted to any one of the circuit interrupters 106 in the fashion set forth above, namely be receiving the connectors 28 in the openings 20, in order to be cooperable with the switch 18 of that circuit interrupter 106 to thereby effect simultaneous movement of all of the circuit interrupters 106 among their various states. Depending upon limitations of the circuit interrupters 106 themselves, it may be more desirable to mount the apparatus 4 to one of the two inboard-situated circuit interrupters 106, such as is shown in FIG. 7, rather than being affixed to one of the two outboard-situated circuit interrupters 106, although such position is not intended to be limiting and is provided merely as an example.

It thus can be seen that the apparatus 4 is relatively simple and inexpensive to manufacture and does not require any modification of the housings 16 in order to be affixable to the circuit interrupter 6. The attachment of the connectors 28 in the openings 20 with the heads 109 being received against the baseplates 36 and with the bodies 102 being received through the holes 40 and into the openings 20 with the engagement surfaces 115 being engaged with corresponding confronting surfaces of the structures 117 causes the apparatus 4 to be affixed to the circuit interrupter 6. Such affixing of the apparatus 4 to the circuit interrupter 6 employs the pro-existing openings 20 and thus avoids the need for a modification of the housing 16 or a modification of the tooling that is used to make the housing 16, which is cost advantageous. Other advantages will be apparent.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A rotary motion switching apparatus that is usable with a circuit interrupter, the circuit interrupter having a housing, a switch situated on the housing, and at least a first opening formed in the housing, the rotary motion switching apparatus comprising:

a base;

an attachment system situated on the base, the attachment system comprising at least a first connector that is elongated, the at least first connector being structured to be at least partially received in the at least a first opening and being further structured to engage the housing within the at least first opening to resist removal of the at least first connector from the at least first opening and to affix the base to the housing;

a crank apparatus situated on the base, the crank apparatus comprising a first portion and a second portion, the first portion being pivotable about an axis of rotation between a first orientation and a second orientation, the first portion and the second portion being engaged with one another at a location spaced from the axis of rotation, at least a part of the second portion being translatable along a movement axis between a first position and a second position, the first portion being in the first orientation when the at least part of the second portion is in the first position, the first portion being in the second orientation when the at least part of the second portion is in the second position; and the second portion having a number of lugs that are structured to engage the switch and to move the switch between a first state and a second state, the at least part of the second portion being structured to be in the first position when the switch is in the first state, the at least part of the second portion being structured to be in the second position when the switch is in the second state.

2. The rotary motion switching apparatus of claim 1 wherein the at least first connector comprises a body and a latch that are structured to be received in the at least first opening, the body being elongated along a direction of elongation, the latch protruding from the body and comprising an engagement surface that is oriented substantially perpendicular to the direction of elongation, the engagement surface being structured to engage a portion of the housing within the at least first opening to resist removal of the body from the at least first opening.

3. The rotary motion switching apparatus of claim 2 wherein the body has formed therein a notch that is elongated and that extends along the direction of elongation, the latch extending from the body in a direction away from the notch.

4. The rotary motion switching apparatus of claim 3 wherein the at least first connector comprises another latch that is structured to be received in the at least first opening, the another latch protruding from the body and comprising another engagement surface that is oriented substantially perpendicular to the direction of elongation, the another engagement surface being structured to engage the housing within the at least first opening to resist removal of the body from the at least first opening, the another latch extending from the body in another direction away from the notch.

5. The rotary motion switching apparatus of claim 4 wherein the direction and the another direction are generally away from one another.

6. The rotary motion switching apparatus of claim 1 wherein the at least first connector comprises a body that is elongated along a direction of elongation and that is structured to be received in the at least first opening, the direction of elongation being oriented substantially parallel with the axis of rotation.

7. The rotary motion switching apparatus of claim 1 wherein the first portion and the second portion are pivotably connected together at the location spaced from the axis of rotation.

8. The rotary motion switching apparatus of claim 1 wherein the first portion has a receptacle formed therein, the receptacle being structured to receive therein an end of a shaft that has a handle situated on another end thereof.

9. The rotary motion switching apparatus of claim 1 wherein the at least part of the second portion comprises a slider that is at least partially situated in a slot formed in the base.

10. The rotary motion switching apparatus of claim 9 wherein the second portion further comprises a link that is pivotably connected between the slider and the first portion.

11. The rotary motion switching apparatus of claim 1 wherein the circuit interrupter has a second opening formed in the housing, and wherein the attachment system further comprises a second connector that is elongated, the second connector being structured to be at least partially received in the second opening and being further structured to engage the housing within the second opening to resist removal of the second connector from the second opening and to further affix the base to the housing.

12. The rotary motion switching apparatus of claim 11 wherein the at least first connector has a first head and a first body, wherein second connector has a second head and a second body, and wherein the base has a first hole and a second hole formed therein, the first body being elongated and being structured to be received in the at least first opening, the first head being received against the base and the first body being at least partially received in the first hole when the first body is received in the at least first opening, the second body being elongated and being structured to be received in the second opening, the second head being received against the base and the second body being at least partially received in the second hole when the second body is received in the second opening.

13. An assembly comprising the rotary motion switching apparatus of claim 1, the assembly further comprising:

a circuit interrupter, the circuit interrupter having a housing, a switch situated on the housing, and at least a first opening formed in the housing;

the at least first connector being at least partially received in the at least a first opening and being engaged with the housing within the at least first opening to resist removal of the at least first connector from the at least first opening and to affix the base to the housing; and the number of lugs being engaged with the switch to move the switch between the first state and the second state, the at least part of the second portion being in the first position when the switch is in the first state, the at least part of the second portion being in the second position when the switch is in the second state.

* * * * *